United States Patent [19]

Naumovich, Jr.

[11] 4,328,652

[45] May 11, 1982

[54] INSULATED STRUCTURE AND METHOD FOR INSULATING A STRUCTURE

[75] Inventor: Nicholas P. Naumovich, Jr., Dallas, Tex.

[73] Assignee: Parsec, Inc., Dallas, Tex.

[21] Appl. No.: 139,149

[22] Filed: Apr. 10, 1980

Related U.S. Application Data

[63] Continuation-in-part of Ser. No. 4,820, Jan. 19, 1979, abandoned.

[51] Int. Cl.[3] ..... E04B 5/00; E04B 1/64

[52] U.S. Cl. ..... 52/408; 52/173 R; 52/410; 52/743; 156/71; 428/44; 428/47; 428/48; 428/55; 428/56

[58] Field of Search ..... 156/71; 52/416, 417, 52/408, 743, 410, 411, 406, 173 R; 428/44, 47, 52, 53, 61, 48, 344, 354, 458, 45, 50, 55, 56, 119, 178, 321, 68, 75, 76

[56] References Cited

U.S. PATENT DOCUMENTS

| | | | |
|---|---|---|---|
| 2,116,270 | 5/1938 | Grand | 52/411 |
| 2,750,315 | 6/1956 | Tierney | 428/295 |
| 2,804,416 | 8/1957 | Plullipsen | 428/344 |
| 2,896,271 | 7/1959 | Kloote et al. | 52/417 |
| 2,943,965 | 7/1960 | Stogre | 428/186 |
| 3,032,438 | 5/1962 | Gaynes et al. | 428/344 |
| 3,058,704 | 10/1962 | Bergstedt | 428/344 |
| 3,106,500 | 10/1963 | Turner | 428/61 |
| 3,135,642 | 6/1964 | Ruffer | 428/61 |
| 3,164,488 | 1/1965 | Workman | 428/416 |
| 3,589,975 | 6/1971 | Andrews et al. | 428/458 |
| 3,729,338 | 4/1973 | Lehmann et al. | 428/344 |
| 3,852,151 | 12/1974 | Knapp | 428/458 |
| 4,077,168 | 3/1978 | Smith | 52/408 |
| 4,115,617 | 9/1978 | Mitsuishi et al. | 428/354 |

*Primary Examiner*—William J. Van Balen
*Attorney, Agent, or Firm*—Sigalos & Levine

[57] ABSTRACT

A method of insulating a structure comprising the steps of applying at least one strip of pliable sealing material in an airtight relationship to an area of the structure to be thermally insulated, and applying, as needed, successive strips of said material in overlapping relationship with each other and said first strip until a desired area of said structure is entirely covered with a continuous, airtight, overlapping, thermal barrier layer, said sealing material comprising a plastic layer, with a pressure-sensitive adhesive on at least one side thereof.

20 Claims, 10 Drawing Figures

INSULATED STRUCTURE AND METHOD FOR INSULATING A STRUCTURE

CROSS-REFERENCE TO RELATED APPLICATION

This is a continuation-in-part application of U.S. patent application Ser. No. 4,820, filed Jan. 19, 1979, now abandoned.

BACKGROUND OF INVENTION

The present invention relates to an insulated structure and a method for insulating a structure by substantially eliminating air infiltration.

With the public awareness of our ever decreasing supplies of fossil energy and the increasing number of people utilizing these diminishing fuels, it has become apparent that energy conservation measures must be taken in order to prolong the availability of fossil fuels for as long a period of time as possible. The matter has become so important that federal legislation has established a comprehensive national program for research and development of all potentially beneficial energy sources and conservation technologies.

One of the greatest demands upon the use of fossil energy is the heating and cooling of inhabited structures such as residences and commercial buildings. Tax incentives are offered to individuals who will increase the insulation in their homes. The problems with heating or cooling a structure are twofold. First is the problem of air infiltration into and out of the structure and second is the rate of heat transfer between the inside and the outside of the structure. If these two factors can be controlled, a tremendous reduction in the cost of heating or cooling a structure would result.

In the construction of a structure, particularly a residential structure, most commonly the skeleton frame of the structure is erected, an interior grade material, such as, for example only, panels of sheetrock, is attached to the interior side of vertical wall studs on the periphery of the structure and an exterior grade material, such as, for example only, panels of wallboard, is attached to the exterior side of the vertical wall studs on the periphery of the structure. Hereinafter, the terms "sheetrock" and "wallboard" will be used to indicate "interior grade material" and "exterior grade material" respectively. Electrical cables encased in metal sheaths and pipes for various uses are routed through the wall space formed between the sheetrock and the outer wallboard by simply drilling a hole through the vertical studs and inserting the sheath or pipe through the hole. Obviously, any air which infiltrates the space between the inner sheetrock and the outer wallboard travels in the wall space through the holes formed for the pipes and electrical cable sheaths to any area where it can escape to the inside of the structure through electrical outlets, cracks caused by imperfect construction, and the like. Further, in the erection of these structures, the wallboard that is being or has been applied to the vertical studs to form the external walls of the structure is often damaged. The wallboard panels are composed of a relatively soft material which is easily damaged by accident such as dropping it or striking objects against it, thus, forming or causing a crack or hole in the material. These cracks and/or holes allow a great deal of air to enter the wall space between the sheetrock forming the inside wall and the wallboard forming the outside wall and allow penetration of that air into the interior of the structure.

Further, when the wallboard is attached to the outside of the vertical studs on the periphery of the structure, it is attached as panels in abutting relationship to each other. This abutting relationship cannot provide an airtight joint and air is able to penetrate the interior of the wall through these abutting panels of wallboard.

In addition, the rate of heat transfer between the interior and the exterior of a structure is dependent upon the type and quality of construction and the amount and type of insulation used during construction. The poorer the quality of construction and the use of construction techniques which do not allow protection from heat transfer, such as dead airspaces, contribute to an increased rate of heat transfer and a corresponding increase in the consumption of energy required to heat or cool the interior of a structure.

Further, if the outer wall is sealed airtight, the air in between the outer and inner walls carries the moisture available inside the structure and if the temperature differential is sufficient, the moisture condenses to form water between the inner and outer wall thus reducing the insulating capability of the ambient air space and causing damage to the building structure.

PRIOR ART

Present day methods of attempting to overcome these problems include the installation of panels or sheets of insulation batting in the space between the vertical studs and the external wallboard prior to the installation of the sheetrock on the interior of the structure. Another known method is to complete the installation of the external wallboard and the internal sheetrock and then fill the space between the vertical studs and the external wallboard and internal sheetrock with a particulate insulation which is a lightweight insulating aggregate that can be blown under air pressure through small orifices properly located in order to fill the wall spaces with the insulating material.

Obviously, these methods are expensive inasmuch as each of the spaces between the vertical studs and the outer wallboard and inner sheetrock must be filled to the level of the roof in order to have complete insulation. Further, these methods do not take into account the infiltration of air into the inner wall space through broken or damaged outer wallboard panels or through the spaces between abutting wallboard panels and around cracks next to windows, doors, pipes, and the like.

Further, in order to reduce the amount of heat transfer between the interior and the exterior of the structure, where possible, dead airspaces are created to form a thermal insulation barrier. Such dead airspaces are placed, for instance, between exterior surface wallboard and finish brick walls. However, they are not entirely satisfactory inasmuch as external ambient temperature air may enter the dead airspace through openings around pipes or fittings or through cracks caused by settling or improper construction, thus causing the dead airspace to become a heat transfer medium instead of a thermal barrier.

SUMMARY OF THE INVENTION

The present invention solves not only the problems of air infiltration into the structure and the rate of heat transfer between the inside and the outside of the structure resulting in greatly decreased heating and cooling costs but also reduces the moisture content that can condense in the wall spaces. The novel invention allows a structure to be totally encased or the external surface of the wallboard to be entirely wrapped with an air impervious material, thus sealing any cracks or damaged areas that may exist in the wallboards as well as sealing the airspaces caused by the imperfectly abutting relationship of the wallboards and sealing the cracks around openings such as windows, doors, casings, protruding pipes, and the like. Also, if the wallboard is of the air and moisture impervious type, then the special air impervious insulating material may be used to seal only cracks, joints, damaged areas and fixture orifices to prevent air and moisture infiltration into the building.

Further, by sealing the inner wall of the structure with said special air and moisture impervious insulating material and then placing the interior grade material such as sheetrock panels over it, moisture and air from within the structure are prevented from passing into the wall spaces thus increasing the insulating capability of the dead air space between the walls and reducing the structural damage caused by water vapor which would have otherwise been condensed in the dead air space.

As used herein, the terms "insulating" or "insulated" means sealing of the structure to make it substantially air and moisture impervious; i.e., provide an air-infiltration and moisture barrier thereby greatly reducing the amount of energy needed to heat and/or cool the structure.

Also, if the insulating material is used on the inside wall as indicated, it must be attached to the vertical wall studs with adhesive or nails, brads or staples. If brads, nails or staples are used, the thin, pliable, metal coated plastic may tear at the fastening point if pressure is applied to it. In such case, a layer of fibrous material may be attached to the adhesive to impart strength to said insulating material to prevent or reduce the tendency to tear at the fastening points.

Briefly stated, the invention relates to a method of insulating a structure by minimizing air infiltration thereinto and therefrom comprising the steps of applying at least one strip of self-adhering, pliable, air impervious insulating material in an airtight relationship to an area of the structure to be insulated against air infiltration to thereby cover any cracks or damaged areas therein and applying as needed, at least one additional strip of said material in overlapping relationship with said first strip until said area of said structure is covered with a continuous, airtight, overlapping, insulating layer of said material, said pliable insulating material comprising a pliable plastic and a pressure-sensitive adhesive on at least one surface of said pliable plastic.

The invention also relates to structure insulated against air infiltration thereinto or therefrom comprising at least one strip of self-adhering, pliable, air impervious, insulating material attached to an area of said structure to be insulated against air infiltration in an airtight relationship thereby covering any cracks or damaged areas therein, said pliable insulating material comprising a pliable plastic capable of accepting an acrylic adhesive and a pressure-sensitive acrylic adhesive on at least one surface of said pliable plastic.

BRIEF DESCRIPTION OF THE DRAWINGS

These and other objects of the instant invention may be had by referring to the following specification and drawings in which like numerals indicate like components and in which.

DESCRIPTION OF THE PREFERRED EMBODIMENT

The preferred embodiment of the present invention is used in the construction of residential type buildings and will be discussed in relation thereto although the insulation and method of insulating disclosed herein could be used with other types of structures.

Figure 1:
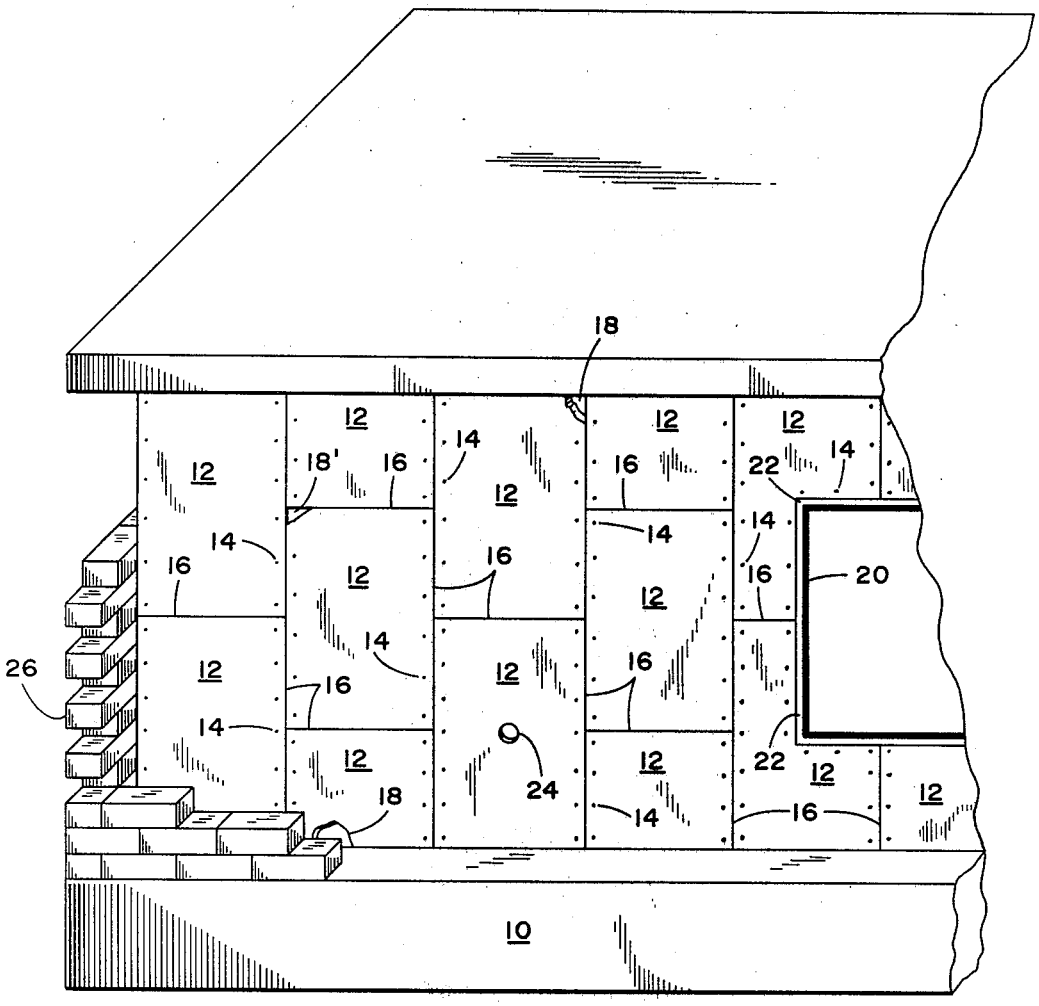
PRIOR ART FIG 1
FIG. 1 is a partial front view of a framed structure having abutting panels of an exterior grade material such as wallboard attached to and covering the outside of the vertical studs forming the peripheral walls of said framed structure.

In the drawings, FIG. 1 is a partial front view of a residential home constructed to the point where the sheets or panels of exterior grade material such as, for example only, wallboard have been attached to the vertical studs thereof to form an outer wall surface. Such a structure is generally constructed on a concrete base or foundation 10 with panels of wallboard 12 nailed or otherwise fastened at 14 to vertical studs (not shown) thus forming an outer wall surface. The panels of wallboard 12 are placed in abutting relationship to each other thus causing joints 16 through which air can pass inasmuch as the panels cannot be perfectly fitted in an airtight relationship to each other. Further, some of the panels have damaged areas 18 which are caused by a variety of reasons. Inasmuch as the wallboard is of generally soft material, it can be easily damaged by handling or by materials accidentally striking it before or after it has been attached to the vertical studs to form a wall surface. Obviously, such damaged areas 18 along with joints 16 allow considerable air to enter therein.

Further, a window frame 20 may be mounted therein and the wallboard 12 has to be cut such as to fit around the window. Because such cuts are generally rough and not precise in nature, cracks 22 exist which again allow air to enter therein. Where it is necessary for an external device such as a fitting or water pipe to be located external the structure, a hole or orifice 24 is drilled through the wallboard 12 to form an opening for the pipe. Again, such orifice cannot be made to form an airtight relationship with the fitting or pipe.

After the wallboard panels 12 have been nailed or otherwise fastened to the vertical studs (not shown) to form the outer wall, a brick outer finish wall 26, shown only partially completed in FIG. 1, is constructed to complete the outer portion of the structure. The brick wall 26 is constructed approximately ¾ of an inch away from the wallboard sheets 12 in order to form a dead airspace to assist in insulating the structure. Obviously, where pipes or fittings must protrude through the brick wall for external use or considering the construction at the top of the brick wall, the wall cannot be made airtight and the air escapes through openings caused by defects in construction to enter the dead airspace between the bricks and the wallboard.

Figure 2:
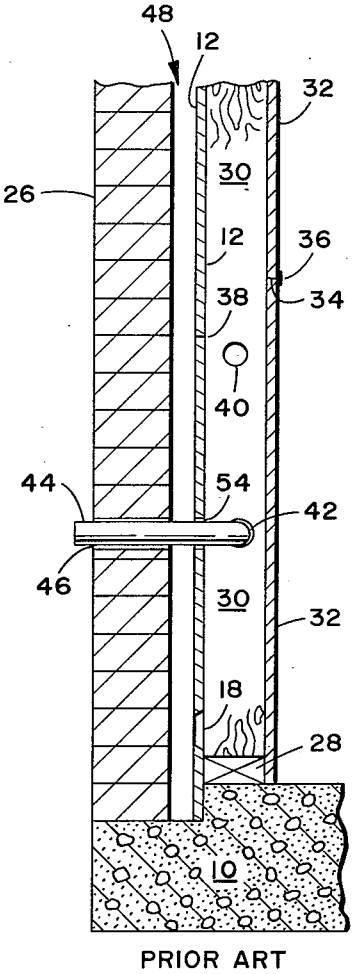
FIG. 2 is a partial cross-sectional view of a structure wall of the prior art.

When the outside ambient air enters the dead airspace between the outer brick wall and the wallboard, it can flow through the interior of the structure because of air pressure differentials on either side of the structure. Thus, as shown in FIG. 2, which is a vertical section of a finished structure wall, suitable protection is not achieved for either air infiltration or for thermal protection of the structure. In FIG. 2, concrete base or foundation 10 has attached thereto by any suitable means, a foundation plate 28 which is usually a 2 inch×6 inch board. Mounted on foundation plate 28 is a plurality of vertical studs 30 which form the wall frames of the structure. The inner walls of the structure are formed by attaching sheets or panels of an interior grade material such as, for example only, sheetrock 32 to the vertical studs 30 in abutting relationship to each other. Any joints 34 existing between adjacent panels of sheetrock 32 are covered by a sealing and filling material 36 in a well-known manner to conceal the location of and form a smooth surface over the joints. Panels of wallboard 12 are also nailed or otherwise fastened to the outer side of vertical studs 30 thus forming an outer wall. The locations 38 where these panels abut each other form cracks which are not sealed and which allow air to enter therein. Orifices 40 and 42 may be made in vertical studs 30 for the purpose of allowing electrical cable sheaths or pipes respectively to pass therethrough. After the wallboard panels 12 have been erected to completely enclose the outer wall structure, a brick wall 26 is erected to provide a finished outer wall to the structure. This brick wall is usually ¾ inch away from the wallboard 12 to create dead airspace 48. An opening may also be made through bricks 26 through which devices such as water pipes 44 may extend for external use about the structure. Obviously, the opening through the brick wall 26 cannot be made sufficiently tight around pipe 44 so as to create an airtight joint. Thus, air seeps through orifices 46 around pipe 44 and enters the dead airspace 48 between the brick wall and wallboard panels 12, and from there, as stated earlier, can enter the space between wallboard panels 12 and sheetrock panels 32. Such air can follow pipe 44 through orifice 42 in vertical stud 30 to any orifice on an inside wall, such as an electrical outlet, where the air can enter the structure interior.

Figure 3:
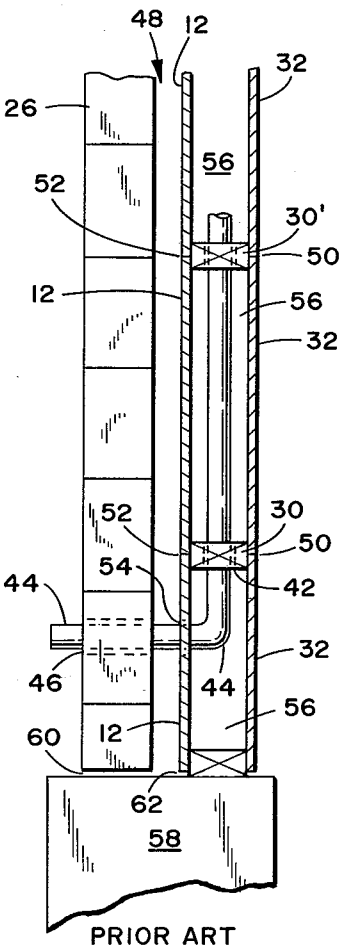
FIG. 3 is a partial top view of a structure wall of the prior art illustrating the relationship of the various components thereof.

This can be seen more clearly in FIG. 3 which is a top view of the prior art wall shown in FIG. 2. As shown in FIG. 3, sheetrock panels 32 are attached to the inside of vertical studs 30 and 30' leaving a joint 50 where they abut. As stated earlier, these joints are taped and covered with a finished sealing material, not shown, to conceal their location. Wallboard panels 12 are nailed or otherwise fastened to the outer side of vertical studs 30 and 30' and also form abutting joints 52 which are not sealed. Brick wall 26 forms the finished outer wall of the structure and is placed approximately ¾ inch away from wallboard panels 12, thus forming a dead airspace 48. As can be seen in FIG. 3, water pipe 44 extends through orifice 46 in brick wall 26 to extend outside and beyond brick wall 26.

As stated earlier, any outside air obtaining access to dead airspace 48, including air passing through orifice 46 around pipe 44, can also pass through orifice 54 in wallboard panel 12 around pipe 44 and enter the wall space between wallboard panels 12 and sheetrock panels 32. The air, once in this location, can follow pipe 44 through the orifice 42 in vertical stud 30 to the next vertical stud 30' and pass through the orifice around pipe 44 in vertical stud 30' to the next compartment. Obviously, the air can continue to pass from one wall compartment 56 to the next until it finds an opening in sheetrock panel 32, such as an electrical outlet, where it enters into the interior of the structure. In actual practice, when high winds are blowing, a negative pressure is formed on the leeward side of the structure thus actually sucking the air through the structure in large volumes. Further, window frame 58 abuts brick wall 26, wallboard panel 12 and sheetrock panel 32. Inasmuch as it is difficult to obtain an airtight connection or joint between the window frame 58 and brick wall 26 and wallboard panels 12 without caulking or other expensive and time consuming methods, the outside air passes through cracks 60 and 62 into the compartments formed by wallboard panels 12, sheetrock panels 32, vertical stud 30 and the body of window frame 58.

Thus, when a wind is blowing on one side of the structure, a pressure differential is created between the windward side and the leeward side of the structure which forces outside air through the cracks as previously mentioned on the windward side of the structure into the interior thereof and to the leeward side where it is withdrawn through similar cracks. Thus, air infiltration is a serious problem in maintaining the environmental integrity of the interior of the structure. Further, the intended insulation barrier formed by dead airspace 48 and the compartments formed by sheetrock panels 32, wallboard panels 12 and vertical studs 30 and 30' is lost or at least its effectiveness is greatly reduced. Also, during the summer months, the heat from the sun is quickly transferred to the dead airspaces, and thus the interior of the structure by the moving air.

It is obviously extremely difficult to economically construct a structure such that is free from damaged areas in the wallboard 12 or to place the sheets of wallboard so closely together and seal the joints such that no airspaces exists and to extend pipes through orifices in the wallboard panels 12 and bricks of the brick wall 26 in such a close fitting relationship that they are airtight. The present invention has solved the problems of the prior art as illustrated herein by providing a novel means of entirely covering the surfaces of the wallboard and any cracks therein including spaces around pipes extending through orifices and spaces between structural components such as window frames and wallboard panels.

Figure 4A:
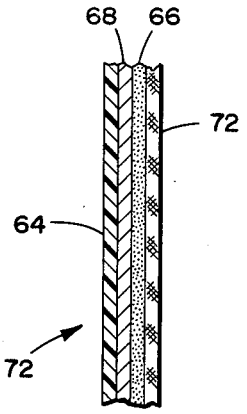
FIG. 4A is a partial cross-sectional view of the thermal insulating material used in the present invention to insulate a structure.

The insulating material used, as shown in FIG. 4A, comprises a highly reflective metallic coating 68 having a very pliable plastic 64 attached on one side thereof and an outdoor type pressure-sensitive adhesive layer 66 on the other side thereof. Such an outdoor type adhesive is functional under a wide range of temperature, either hot or cold. The insulating material can be formed in any width, but preferably in a width of 36 inches and rolled in any desired lengths for practical handling. It can easily be cut to a desired length or shape. For ease of handling, it is preferred to cover the pressure-sensitive adhesive with a protective sheet 70, preferably of paper, covered with a release coat so that the protective sheet can be removed just prior to use of the material. If used in rolls, the release coating may be placed on the reverse side of the plastic eliminating the need for the protective paper covering. This is a conventional technique used in rolls of self-adhering tape and foils.

As to the plastic, it is preferred to use a polyethylene terephthalate (MYLAR) film having a thickness of about ½ to 3 mils, although any plastic can be utilized which is capable of being stretched substantially without breaking or becoming pervious to air and to which a metallic layer can be adhered. Suitable examples are polypropylene, polyvinyl chloride, nylons, and the like. It will be understood that some plastics may require some treatment, as by corona discharge, in order to adhere the metallic layer thereto.

With respect to the metallic layer, aluminum, vacuum deposited onto the plastic, is preferred, but any other well-known highly reflective metals such as chrome, gold, and the like can be used. Also the metallic layer can be applied to the plastic film by any known technique in addition to vacuum deposition.

The metallic layer is deposited on the underside of said plastic between the plastic and the adhesive. In this manner, the fragile metallic layer is protected from physical damage or oxidation.

The pressure-sensitive adhesive used can be any of those well-known in the art which are water-soluble and moisture-proof. These are conventional and well-known as disclosed in U.S. Pat. Nos. 2,804,416 and 3,729,338. The acrylic based pressure-sensitive adhesives are most suitable with those retaining their adhesive character at temperatures as low as about 20° to 25° F. being preferred. This permits application of the insulating material under even severe weather conditions.

The thickness of the insulating layer is not critical and is determined primarily by cost and a thickness necessary to insure that the plastic, even when stretched as when the structure settles, will be impervious to air. Under most common conditions a plastic film thickness of ½ to 3 mils is suitable with the metal if used, being of a like thickness or less. There is no criticality as to the adhesive layer thickness.

Figure 5:
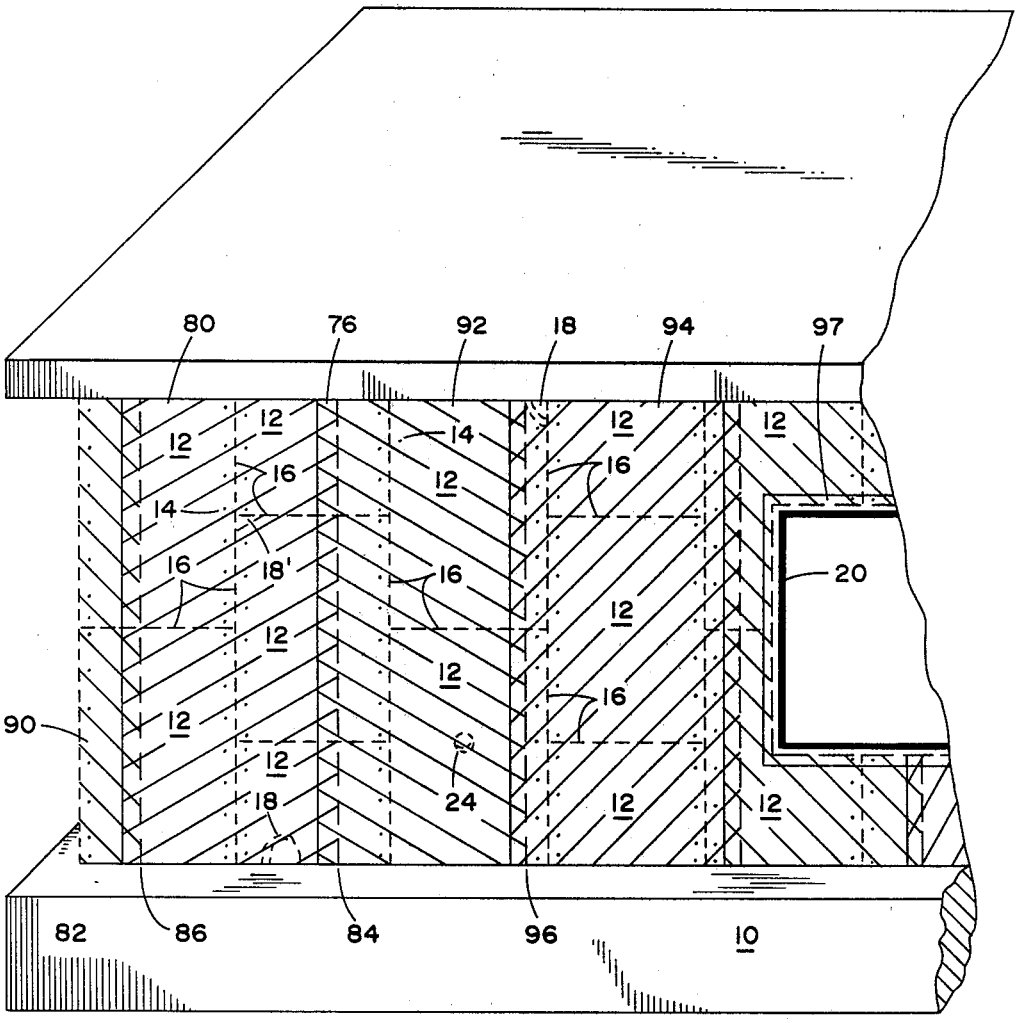
FIG. 5 is a partial front view of a framed structure having wallboard sheets attached to the vertical studs thereof as shown in FIG. 1 and illustrating the manner in which the insulating material of the present invention is applied thereto in an overlapping manner to provide an airtight seal and thermal insulation for said structure.

Thus, FIG. 5 illustrates the structure of the prior art shown in FIG. 1 as modified by the present invention with the use of the insulating material 72 to provide an airtight seal. In FIG. 5, a panel or sheet of insulating material 80 extends from edge 82 to edge 84 thus overlapping insulating sheet 90 whose outer edge is shown by dashed line 86. Insulating sheet 92 overlaps trailing edge 84 of insulating sheet 80 thus forming an airtight seal. Also, insulating sheet 80 covers damaged areas 18 and 18' in wallboard 12 effectively sealing them against any air leaks. Insulating sheet 94 overlaps the trailing edge 96 of insulating sheet 92. In like manner, the insulating sheets are overlapped completely around the structure until first insulating sheet 90 is met and overlapped. Notice also, around window frame 20, that a narrow sheet 97 of insulating material is applied which effectively seals any cracks which may exist between window frame 20 and wallboard panel 12.

Figure 6:
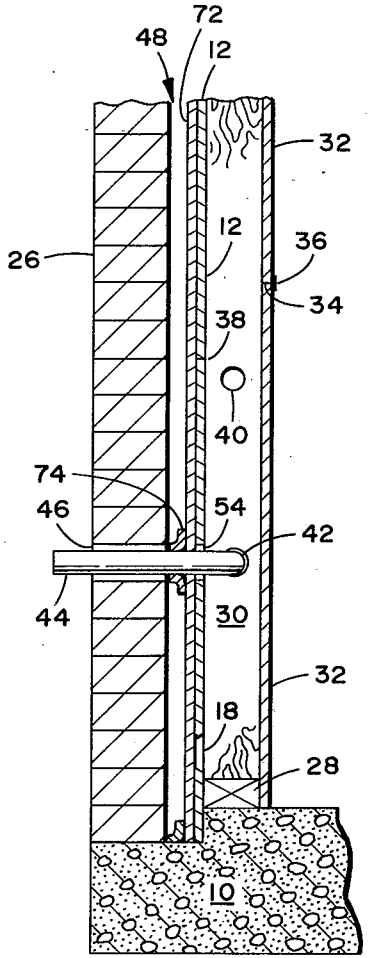
FIG. 6 is a partial cross-sectional view of a structure wall illustrating the manner in which the insulating material of the present invention is applied to said wallboard to seal any cracks or openings thereby preventing infiltration of external air into the inside of said structure.

Accordingly, a partial cross-section of a structure wall constructed in accordance with the teachings of the present invention to provide both thermal insulation and a decrease of air infiltration into the structure is shown in FIG. 6. Again, concrete base or foundation 10 supports base plate 28 on which rests vertical studs 30. Nailed or otherwise fastened to the interior side of vertical studs 30 are panels of sheetrock 32 which have joints 34 formed by abutting panels which are concealed by tape and a sealing material 36 well-known in the art. On the outer side of vertical studs 30, panels of wallboard 12 are nailed or otherwise fastened thereto also leaving joints 38 between abutting panels 12. Again, the panels 12 may have a number of damaged areas 18, one of which is shown in FIG. 6. Vertical studs 30 may also have orifices 40 and 42 through which electrical cable sheath and pipes may be located such as pipe 44 passing through orifice 42 in FIG. 6. Before constructing brick wall 26, however, sheets or panels of insulating material 72 are applied in overlapping relationship to wallboard panels 12 thus covering the wallboards 12 in their entirety, including any joints 38 caused by abutting panels 12 and damaged areas 18 in panels 12. Further, inasmuch as pipe 46 must also pass through insulation material 72, a thin strip 74 of insulation material 72 may be wrapped around and pressed tightly against both the pipe 44 and the insulating material 72 on wallboard 12 to form a fairing or seal which is airtight and prevents any air from passing from the outside of brick wall 26 along pipe 44 through orifice 42 in FIG. 6. Before constructing brick wall 26, however, sheets or panels of insulating material 72 are applied in overlapping relationship to wallboard panels 12 thus covering the wallboards 12 in their entirety, including any cracks 38 caused by abutting panels 12 and damaged areas 18 in panels 12. Further, inasmuch as pipe 46 must also pass through insulation material 72, a thin strip 74 of insulation material 72 may be wrapped around and pressed tightly against both the pipe 44 and the insulating material 72 on wallboard 12 to form a fairing or seal which is airtight and prevents any air from passing from the outside of brick wall 26 along pipe 44 through orifice 54 of wallboard panel 12.

Figure 7:
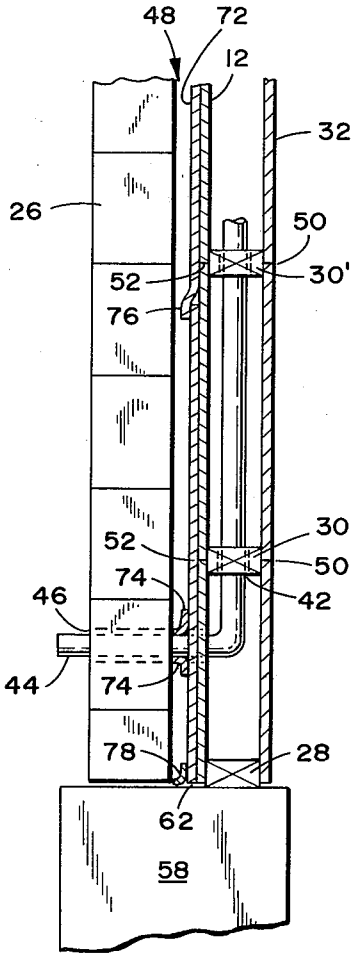
FIG. 7 is a partial top view of a structure wall illustrating the manner in which the insulating material of the present invention is applied to said wallboard in the overlapping manner to completely seal any cracks or openings therein.

FIG. 7 is a partial top view of a structure wall such as that shown in FIG. 6 illustrating the manner in which the insulation sheets or panels 72 are overlapped at 76 to form an airtight seal which prevents outside air from passing through any cracks or defective or damaged areas of wallboard panels 12. Thus, sheetrock panels 32 abut each other and form a joint 50 at vertical studs 30 and 30'. These joints are concealed in a well-known manner as described earlier.

Wallboard panels 12 also abut each other and form a joint 52 at vertical studs 30 and 30'. When sheets of insulating material 72 are applied and stuck to wallboard panels 12 by adhesive 66 shown in FIG. 4, the seams or joints 52 are covered and made airtight. Further, the sheets of insulating material 72 overlap as shown at 76 and again form an airtight seal which prevents any outside air from passing through wallboard panels 12 into the compartments formed by the interior sheetrock panels 32, exterior wallboard panels 12 and vertical studs 30 and 30' as shown in FIG. 7. As stated previously, narrow strips 74 of insulating material 72 may be wrapped around and applied to pipe 44 and wallboard 12 in such a manner as to produce a fairing or airtight seal 74 closing off any space between pipe 44 and wallboard 12 and preventing air from passing along that opening into the space between wallboard panels 12 and sheetrock panels 32. Further, narrow strips of insulation material 72 may be applied to the sidewall of window frame 58 and wallboard 12 to form another fairing or airtight seal 78 which keeps any air from passing through crack 62 to the interior of the wall or structure. Thus, as can be seen in FIG. 7, dead airspace 48 truly becomes a dead airspace inasmuch as no air movement can take place therein. Dead airspace 48 thus acts as it was intended as an insulation barrier. With insulating material 72 applied to wallboard panels 12 and having a metallic or reflective aluminum coating 68 applied thereto, a thermal insulator is obtained against both conductive heat and radiant heat. Also, inasmuch as the pressure-sensitive adhesive 66 is normally applied in a spongy condition, tiny cracks are not just covered but are filled to ensure an airtight seal. Further, if nails are required to be driven through the insulation material 72 for any reason, the pressure-sensitive adhesive adheres tightly to the nail thus forming an airtight seal around the nail.

Although the preferred embodiment has been disclosed herein as utilizing an insulating material having a pliable, highly reflective, metallic coating at the outer face thereof for use with a dead airspace, in those structures that are constructed without a dead airspace, such as when wood siding is applied directly to the wallboard 12, it is not necessary, although helpful, to have the inner face of the insulating material 72 coated with a reflective metallic coating. In such cases, the thin pliable plastic 64 with the metallic coating 68 and pressure-sensitive adhesive 66 on one side thereof may be effectively used to form an airtight seal over the wallboard 12 and prevent air from passing therethrough. Further, in this construction, and others where nailing is done through the insulating material 72, the instant invention provides a further advantage in that the pressure-sensitive adhesive seals the opening caused by the nails to maintain the air-impervious integrity of the insulating material 72.

Figure 8:
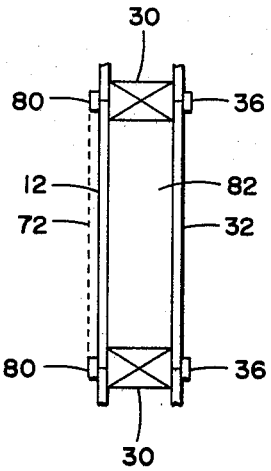
FIG. 8 is a top view of a partial cross-sectional view of a structure wall showing only the outer wall insulated by use of the unique invention disclosed herein.

Thus, a partial cross-sectional view of the finished wall is shown in FIG. 8. Vertical wall studs 30 have an interior grade material such as sheetrock 32, for example, attached on the inside and an exterior grade material such as wallboard 12, for example, attached to the outside. The insulating material 72 may be overlapped and covering the outside of the entire outer wall as explained earlier.

It is also known, however, that wallboard 12 itself may be treated so as to be air and moisture impervious. If such wallboard 12 is used, it is not necessary to cover the outside of the entire wall as explained earlier. Instead, small strips 80 of the insulating material 72 may be used to seal joints or individual cracks or damaged areas. This, of course, saves time and cost of the extra insulating material but causes increased cost of the wallboard 12.

Figure 9:
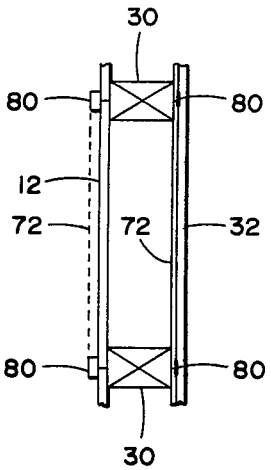
FIG. 9 is a top view of a partial cross-sectional view of a structure wall showing both the outer wall and inner wall insulated by use of the unique invention disclosed herein.

When the outside wall is sealed airtight with the insulating material 72 of the present invention, the moisture laden air from the interior of the structure enters the wall space 82 and, if the proper temperature differentials exist, may condense in the wall space 82 to form water which can, of course, damage the wall structure. If it is desired to further insulate the structure and prevent condensation in the wall space 82, the inner wall may also be sealed. Such a wall is shown in FIG. 9 and is basically constructed as explained in relation to the structure in FIG. 8. However, in FIG. 9, a sheet of the novel insulating material 72 is placed between the inside of vertical studs 30 and the sheetrock 32. The sheets of insulating material 72 may either overlap or abut on the vertical studs 30. If they abut, the joints may be sealed with small strips 80 of the insulating material 82. The interior grade material such as sheetrock 32 is then placed over the insulating material to form a wall having extremely good insulating characteristics.

Figure 4B:
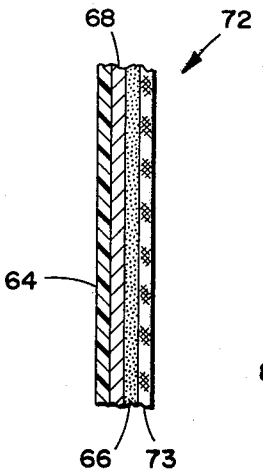
FIG. 4B is a partial cross-sectional view of an alternate embodiment of the thermal insulating material used in the present invention to insulate a structure wherein a tough fiberous material is attached to said adhesive thereby strengthening said thermal insulating material.

The insulating material 72 in FIG. 9 which is located under the sheetrock 32 may be glued or otherwise fastened to vertical studs 30 by means such as nails, tacks, brads, staples and the like. In such case, after the nail or other sharp fastener is in place, any undue force on the very thin plastic based insulation causes the material to rip at the fastening point and thus not only creates difficulties in attaching the insulating material but also causes openings which destroy or reduce the insulating properties of the wall construction. In such case, the insulating material may be strengthened as shown in FIG. 4B by the addition of a layer of fibrous material 73 to the adhesive layer 66 instead of the protective covering 70. Such fibrous layer may be a material such as that commercially available as TYVEK. This material is extemely thin and pliable but has coarse fibers therein which resist tearing and are so strong that the material has to be cut and cannot be torn. When the insulating material 72 is thus reinforced, it can be nailed, tacked, stapled or otherwise fastened to studs 30 without being torn or ripped during handling. If desired, another layer of adhesive could be placed over said fibrous material so that the strengthened insulating material could be applied directly to a surface without nailing, stapling and the like.

It can be seen that a structure can be insulated in various degrees by various means depending upon the cost and degree of insulation required. Either the outside wall only or the inside wall only may be insulated with the novel insulating material described herein. If desired, both the outside wall and inside wall may be insulated. The outside wall may be entirely wrapped or air and moisture impervious exterior grade material may be used and just the joints, cracks or damaged areas covered with the novel insulating material. When the inner wall is insulated, either the novel insulating material with adhesive can be used or the novel insulating material with the layer of tough fibrous material may be used to prevent tearing or ripping of the insulating material.

In this manner the costs are reduced for the insulation material while still achieving a reduction in the total amount of air infiltration to the interior of the building, thus maintaining a stable interior temperature. Therefore, the present invention is a significant energy saving contribution to the art inasmuch as it will enable both heating and cooling costs to be significantly reduced.

Thus, the present invention provides a substantial advance as an energy saving device and method by not only providing a thermal insulator against both conductive heat and radiant heat, but also an airtight structure which reduces or prevents altogether air infiltration into the interior of the structure thereby stabilizing the temperature of the interior of the structure at a desired level.

While the invention has been disclosed in connection with a preferred embodiment, it is not intended to limit the invention to the particular form set forth, but, on the contrary, it is intended to cover such alternatives, modifications, and equivalents as may be included within the spirit and scope of the invention as defined by the appended claims.

What is claimed is:

1. A method of insulating a structure by minimizing air infiltration thereinto and therefrom comprising the steps of:

(a) applying at least one strip of self-adhering, pliable, air impervious insulating material in an airtight relationship to an area of the structure to be insulated against air infiltration to thereby cover any cracks, joints or damaged areas therein, and (b) applying as needed at least one additional strip of said material in overlapping relationship with said first strip until said area is covered with a continuous, airtight, overlapping, insulating layer of said material, (c) said pliable insulating material comprising a pliable plastic and a pressure-sensitive adhesive on at least one surface of said pliable plastic.

2. The method of claim 1 including the step of sealing cracks not covered by said strips such as those in structural areas near openings having protrusions therethrough by forming an airtight fairing which seals said cracks with said insulation material.

3. The method of claim 1 wherein said pliable insulating material has a layer of a reflective metal coated on said plastic between said plastic and said adhesive.

4. The method of claim 3 wherein said pliable plastic is polyethylene terephthalate and said reflective metal is aluminum.

5. The method of claim 4 wherein said plastic has a thickness of from about ½ to 3 mils.

6. The method of claim 5 wherein the pliable insulating material consists essentially of a sheet of polyethylene terephthalate having a thickness of about ½ to 3 mils, a vacuum deposited layer of aluminum on at least one surface thereof, and a coating of a pressure-sensitive acrylic adhesive on said aluminum capable of adhering to a structure surface at temeratures as low as about 20° F. on said aluminum.

7. The method of claims 1 or 6 wherein all the exterior walls of said structure are covered with a continuous, airtight, overlapping, insulating seal of said material.

8. A structure insulated against air infiltration thereinto or therefrom comprising at least one strip of self-adhering pliable, air impervious, insulating material attached to an area of said structure to be insulated against air infiltration in an airtight relationship thereby covering any cracks or damaged areas therein, said pliable insulating material comprising a pliable plastic and a pressure-sensitive adhesive on at least one surface of said pliable plastic.

9. The structure of claim 8 comprising successive strips of said pliable insulating material attached to the area of said structure to be insulated in overlapping relationship with each other and said first strip to form a continuous, airtight, thermal insulating seal.

10. The structure of claim 8 or 9 wherein all the exterior walls of the structure are covered with a continuous, airtight, overlapping, insulating layer of said material.

11. The structure of claim 8 or 9 wherein said plastic insulating material consists essentially of a sheet of polyethylene terephthalate having a thickness of about ½ to 3 mils, a vacuum deposited layer of aluminum on at least one surface thereof, and a pressure-sensitive acrylic adhesive on said aluminum capable of adhering to a surface at temperatures as low as about 20° F.

12. In a structure comprising a base, a plurality of spaced, vertical, exterior wall supporting studs mounted on said base, abutting panels of exterior grade material attached to and covering the outside of said vertical studs to form an outside wall and abutting panels of interior grade material attached to and covering the inside of said vertical studs thereby forming an inside wall with a wall space between said inside and outside walls formed by said interior and exterior grade panels, insulation for such structure comprising:

(a) a sheet of self-adhering pliable insulating material placed over and attached in an airtight manner to a predetermined area of said exterior grade panels, and (b) successive sheets of said pliable insulating material placed over and attached in an airtight manner to the remaining area of said exterior grade panels in overlapping relationship with each other and with said first sheet to form a continuous, airtight, insulating seal over said exterior grade material, (c) said pliable insulating material comprising a pliable plastic and a pressure-sensitive adhesive on at least one surface of said pliable plastic.

13. The structure of claim 12 wherein said insulating material comprises:

(a) a first layer of polyethylene terephthalate having a thickness of from about ½ to 3 mils, (b) a second layer of aluminum bonded to one side of said plastic, and (c) a third layer of pressure-sensitive acrylic adhesive over said second layer adapted to adhere to said structure.

14. The structure of claim 13 further including a dead airspace formed by said insulation covered exterior grade material and an external finish wall spaced therefrom.

15. A structure as in claim 14 wherein said self-adhering adhesive is of the type which can be applied at temperatures as low as about 20° F.

16. A method of insulating a structure having a base, a plurality of spaced, vertical, exterior wall supporting studs mounted on said base, abutting panels of exterior grade material attached to and covering the outside of said vertical studs to form an outside wall and abutting panels of interior grade material attached to and covering the inside of said vertical studs to form an inside wall with a wall space between said inside and outside walls formed by said interior and exterior grade panels, said method comprising:

(a) utilizing exterior grade panels that are air and moisture impervious, and (b) sealing only exterior grade panel joints, cracks or damaged areas with self-adhering, pliable, air impervious insulating material, (c) said insulating material comprising a pliable plastic and a pressure-sensitive adhesive on one surface of said pliable plastic.

17. A method as in claim 16 wherein said insulating material includes a layer of reflective metal coated on said plastic between said plastic and said adhesive.

18. A method of insulating a structure having a base, a plurality of spaced, vertical, exterior wall supporting studs mounted on said base, abutting panels of exterior grade material attached to and covering the outside of said vertical studs to form an outside wall and abutting panels of interior grade material attached to and covering the inside of said vertical studs to form an inside wall with a wall space between said inside and outside walls formed by said interior and exterior grade panels, said method comprising:

(a) placing an air impervious, pliable, insulating material between the inside of said vertical studs and said interior grade material panels to seal said inside wall, (b) said insulating material comprising a pliable plastic and a pressure-sensitive adhesive on one surface of said pliable plastic.

19. A method as in claim 18 wherein said insulating material includes a layer of reflective metal coated on said plastic between said plastic and said adhesive.

20. A method as in claim 19 wherein said insulating material placed between said interior grade material panel and said vertical wall studs further includes a layer of fibrous material attached to said adhesive for strengthening purposes.

* * * * *